United States Patent [19]

Matievic

[11] Patent Number: 4,697,932

[45] Date of Patent: Oct. 6, 1987

[54] MULTI-SIGNAL ALARM

[75] Inventor: Miroslav Matievic, Indianapolis, Ind.

[73] Assignee: Emhart Industries, Inc., Indianapolis, Ind.

[21] Appl. No.: 807,687

[22] Filed: Dec. 11, 1985

[51] Int. Cl.[4] ..... G04C 21/16

[52] U.S. Cl. ..... 368/255; 368/250

[58] Field of Search ..... 368/250, 244, 255, 245

[56] References Cited

U.S. PATENT DOCUMENTS

| | | | |
|---|---|---|---|
| 3,879,931 | 4/1975 | Yasuda et al. | 368/255 |
| 3,906,713 | 9/1975 | Suda et al. | 368/255 |
| 3,961,284 | 6/1976 | Shora | 331/159 |
| 4,068,461 | 1/1978 | Fassett et al. | 368/255 |
| 4,107,625 | 8/1978 | de Mere | 368/159 |
| 4,316,273 | 2/1982 | Jetter | 368/250 |

FOREIGN PATENT DOCUMENTS

| | | | |
|---|---|---|---|
| 2551665 | 11/1975 | Fed. Rep. of Germany | 368/255 |
| 2843656 | 4/1980 | Fed. Rep. of Germany | 368/255 |

*Primary Examiner*—Bernard Roskoski

*Attorney, Agent, or Firm*—Robert F. Meyer; Carl A. Forest

[57] ABSTRACT

A piezoelectric signaling device that produces a predetermined number of audio signals when activated. The device includes a timer, a pulser, an audio oscillator, and a piezoelectric transducer. The timer enables the pulser for a predetermined time. While enabled, the pulser produces pulses at a predetermined rate, thus producing a predetermined number of pulses. The oscillator is enabled during the pulses to produce a predetermined number of pulses of audio frequency electrical oscillations which are applied to the piezoelectric transducer to produce the predetermined number of audio signals.

4 Claims, 4 Drawing Figures

MULTI-SIGNAL ALARM

BACKGROUND OF THE INVENTION

1. Field of the Invention.

The invention in general relates to audio tone signaling devices and more particularly to a device which produces a predetermined number of signals when activated.

2. Designation of the Prior Art.

Audio tone signaling devices are widely used for applications such as to signal the existence of a condition, the end of an operating cycle, the end of a period of time, or as a reminder of something. As the use of audio signaling devices have proliferated, it has become desirable to differentiate between their signals. Generally, this has been done by the use of different tones for different conditions etc. However, it has been found that it is generally difficult to devise tones that are easily differentiated when they are not simultaneous without introducing tones that are to some extent jarring. Further, it is relatively expensive to produce a line of alarms with a wide variety of tones, since each different tone requires a different frequency of oscillation and may require different system elements, such as resonant cavities, for efficient sound production. Since many products which employ audio signaling devices today are quite inexpensive, it is important that the signaling device itself be inexpensive, so that it does not contribute inordinately to the total cost of the product. It, therefore, would be highly desirable to have a signaling device that is inexpensive to manufacture and which can easily be adjusted or modified to produce a distinctive signal.

SUMMARY OF THE INVENTION

The invention provides an audio device that may be used to uniquely signal a particular condition by sounding a unique number of audio tones.

It is an object of the invention to provide an inexpensive signaling device that can be easily customized to produce a desired number of audio signals.

The signaling device according to the invention comprises a timer for producing a time signal defining a predetermined time, a pulser responsive to the timer signal for producing electrical pulses at a predetermined rate for the predetermined time, an electrical oscillator including a piezoelectric transducer and responsive to the electrical pulser for producing a predetermined number of audio signals.

The signaling device according to the invention can be made to produce any number of pulses simply by changing a single inexpensive capacitor and resistor. Numerous other features, objects, and advantages of the invention will become apparent from the following detailed description when read in conjunction with the accompanying drawings.

DESCRIPTION OF THE PREFERRED EMBODIMENT

Figure 1:
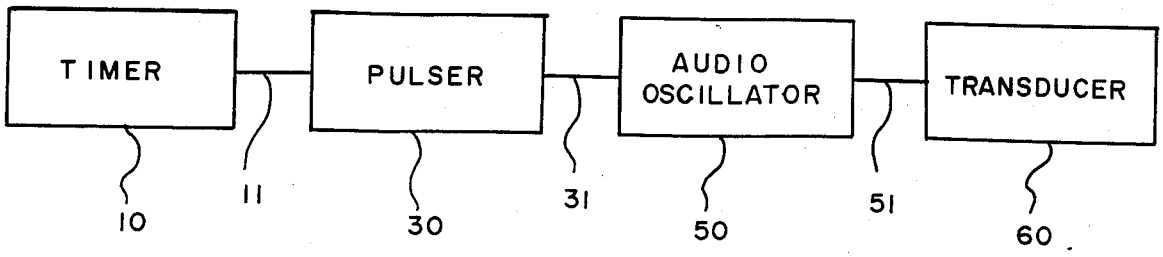
FIG. 1 is a block diagram of the preferred embodiment of the signaling device according to the invention.
Figure 2:
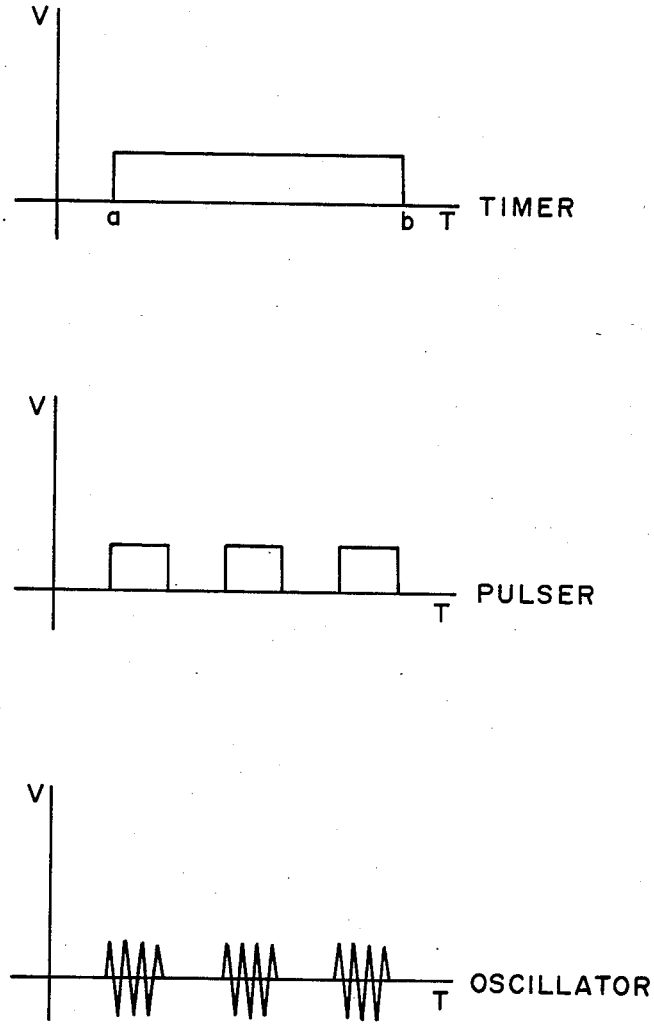
FIG. 2 is a timing diagram of the outputs of the timer, pulser and oscillator.

Direction attention to FIG. 1, a block diagram of the invention is shown. The invention includes: a timer means 10 for producing a timer signal on its output line 11, which signal defines a predetermined time; a pulser means 30 responsive to the timer signal on line 11 for producing pulse signals at a predetermined rate during the predetermined time, which pulse signals are output on line 31; an electrical oscillator means 50 responsive to the pulser signals on line 31 for producing a predetermined number of pulses of electrical oscillations at audio oscillation frequencies which oscillation pulses are output on line 51, and a piezoelectric transducer means 60 responsive to the pulses of electrical oscillation on line 51 for producing a predetermined number of audio signals. Exemplary timing diagrams of the signals output on lines 11, 31 and 51 are shown in FIG. 2. The timer signal output on line 11 is shown in the upper diagram, the pulse signal output on line 31 is shown in the middle diagram, and the pulses of electrical oscillations output on line 51 are shown in the lower diagram. The timer signal defines a time b-a. As seen on the middle diagram, the pulser 30 emits three pulse signals during this time. And, as seen in the lower diagram, the oscillator 50 in turn emits three pulses of oscillation in the pulse periods determined by the pulser 30. These electrical oscillations are at audio frequencies and are applied to the transducer 60 to produce three audio signal tones. By examining the timing diagrams, it can be seen that simply by changing the length of the defined time b-a, the number of pulses emitted and the number of signal tones can be changed. Or, alternatively, by changing the rate of the pulser 30, the number of pulses emitted in the time b-a can be changed, which also will change the number of signal tones emitted.

Figure 3:
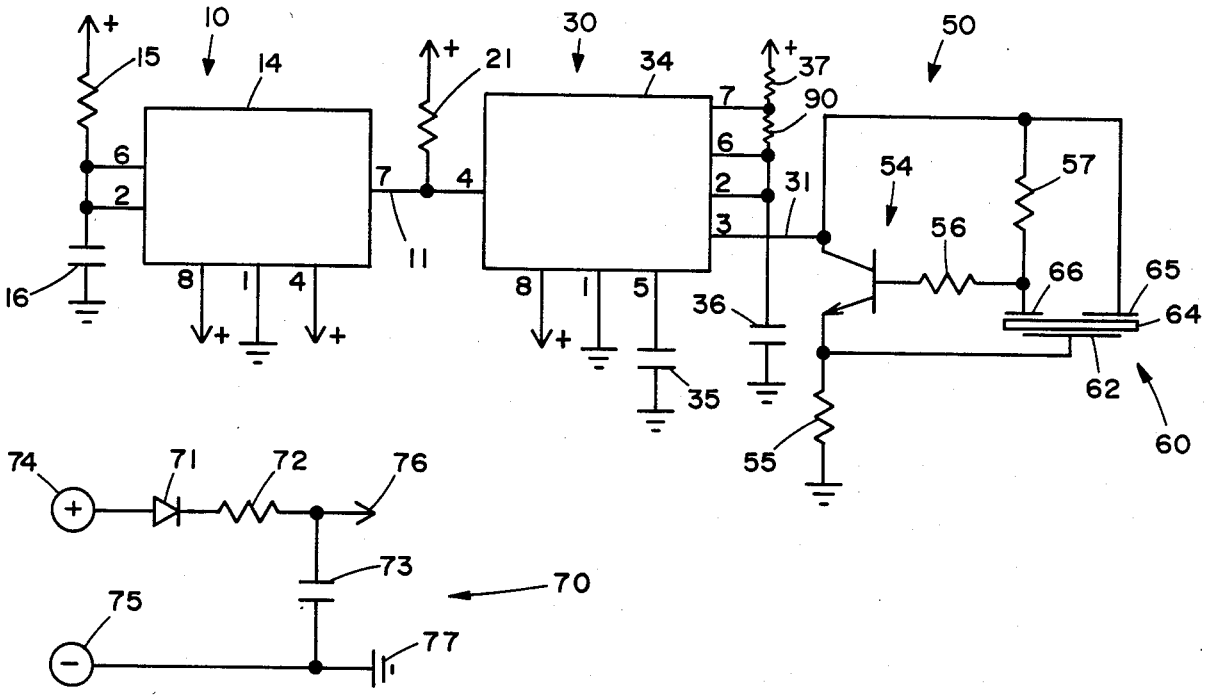
FIG. 3 is a detailed electronic circuit diagram of the preferred embodiment of the invention.

Turning now to the detailed description of the electronic circuitry of the invention, we refer to FIG. 3. The circuit includes a power conditioner circuit which includes diode 71 used for polarity protection, current limiting resistor 72 and filter capacitor 73. A d.c. voltage source is applied across terminals 74 and 75. The anode of diode 71 is connected to the positive voltage terminal 74 and its cathode is connected to the positive circuit voltage inputs through resistor 72. The negative terminal 75 is directly connected to the circuit grounds. Capacitor 73 is connected between the circuit positive voltage line 76 and the circuit negative voltage (ground) line 77.

The timer 10 of the embodiment of FIG. 3 includes IC 14 used as a multivibrator, resistor 15 and capacitor 16. The threshold input and the trigger input (number 6 and 2 pins respectively) of multivibrator 14 are connected to the positive circuit voltage through resistor 15 and to the system ground through capacitor 16. The positiv input and the reset input (the number 8 and 4 pins respectively) of multivibrator 14 are connected to the positive circuit voltage. The multivibrator ground input (pin 1) is connected to the circuit ground. The output (pin 7) is connected to the circuit positive voltage line through resistor 21.

The pulser 30 comprises multivibrator 34, capacitors 35 and 36 and resistor 37. The output (pin 7) of timer multivibrator 14 is connected to the reset input (pin 4)

of pulser multivibrator 34. The positive voltage input (pin 8) of the multivibrator 34 is connected to the circuit positive voltage and the ground (pin 1) is connected to the circuit ground. The control input (pin 5) is connected to ground through capacitor 35. The trigger and threshold inputs (pins 2 and 6 respectively) are connected to pin 7 through resistor 90 and to the circuit ground through capacitor 36. Pin 7 is connected to the positive circuit voltage through resistor 37. The audio oscillator 50, in this case, comprises transistor 54, resistors 55, 56 and 57, and the transducer 60 which forms part of the feedback circuit of the oscillator. The emitter of transistor 54 is connected to ground through resistor 55 and to the metal electrode 62 of transducer 60. The collector of transistor 54 is connected to the output (pin 3) of multivibrator 34, and to the silver electrode 65 of transducer 60. The feedback electrode 66 of transducer 60 is connected to the collector and base of transistor 54. Transducer 60 comprises piezoelectric crystal 64 and the electrodes 62, 65 and 66 previously mentioned.

In the embodiment shown, diode 71 is a type 1N4148, multivibrators 14 and 34 are type LM555, resistors 72, 15, 21, 37, 55, 56, 57 and 90 are 330K ohm, 2.4M ohm, 10K ohm, 100K ohm, 2.7K ohm, 1K ohm, 47K ohm, and 680K ohm respectively. Capacitors 73, 16, 35, and 36 are 0.1 microfarad, 1. microfarad, 0.01 microfarad, and 1. microfarad respectively. Transistor 54 is preferably a type 2N3904. The d.c. power source is preferably about 12 volts d.c.

The preferred embodiment of the invention of FIG. 3 operates as follows. When power is switched on, the timer 10 generates a "high" signal on line 11 for a time determined by the values of resistor 15 and capacitor 16. In the disclosed embodiment this time is approximately 3 seconds. The high signal on line 11 enables pulser 34 for the approximately 3 second time period during which it produces pulses of high voltage on line 31 at a rate determined by the values of resistors 37 and 90 and capacitor 36. In the disclosed embodiment, this rate is approximately 1 per second, resulting in three ½ second pulses separated by ½ second pause. The audio oscillator 50 is enabled during the high pulses on line 31 to oscillate at its resonant frequency, which in the embodiment disclosed is approximately three kilocycles. The oscillations of oscillator 50 drive transducer 60 to produce three audio tones of approximately ½ second duration separated by quiet periods which are also approximately ½ second in duration.

The number of tone pulses may be changed by replacing resistor 15 and capacitor 16 with a resistor and capacitor of a different value to produce a different number of tones of approximately ½ second duration. Or, alternatively, resistor 37 and capacitor 36 may be changed to provide more or less pulses (and thus tones) of different duration over the same approximate 3 second time period. Or both capacitive/resistor pairs may be changed to produce a different number of tones of different duration.

Figure 4:
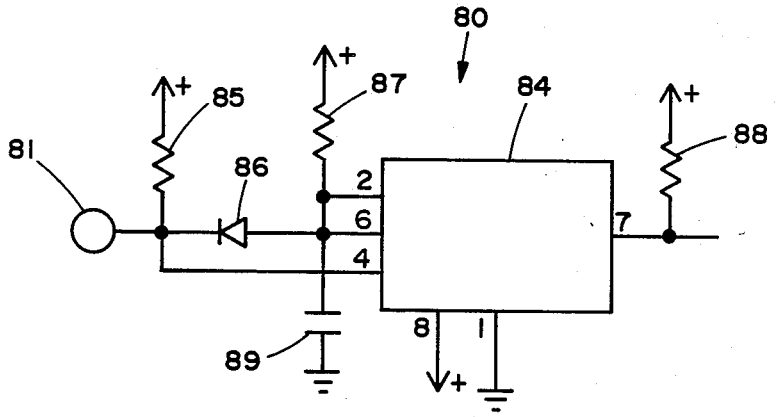
FIG. 4 is a detailed electronic circuit diagram of a portion of the circuit of an alternative preferred embodiment of the invention.

An alternative embodiment of the timer portion of the circuitry is shown in FIG. 4. This embodiment is modified by adding an input terminal 81, a resistor 85 and a diode 86 to the timer circuit of FIG. 3. Diode 86 is connected between the trigger and threshold terminals (pins 2 and 6, respectively) of multivibrator 84 and the terminal 81 with the cathode toward the terminal. The terminal 81 is also connected to the positive voltage line through resistor 85 and to the reset input (pin 4) of multivibrator 84. In this embodiment, resistor 87 is preferably 2.4 M ohm and diode 86 is preferably a type 1N4148. Also in this embodiment, resistors 85 and 88 are preferably each 10K ohm. The values of the other components remain the same.

The signal device of FIG. 4 operates as follows. When the power is switched on, the three tones are produced as before. However, capacitor 89 now discharges through diode 86 and the reset terminal is pulled high through resistor 85. This resets timer 80. When a low pulse is applied to terminal 81, the reset starts the timer again and the circuit again sounds three signal tones. Each time a low pulse is applied to terminal 81 three signal tones will sound.

A novel signaling device which produces a predetermined number of tone pulses has been described. It is evident that those skilled in the art may now make many uses and modifications of the specific embodiments described, without departing from the inventive concepts. It is contemplated that other capacitors and resistors will be used to produce different numbers of signals at different rates and over different time periods. Other equivalent electronic components or oscillator with transducer may also be used. Consequently, the invention is to be construed as embracing each and every novel feature and novel combination of features present in the signaling device described.

What is claimed is:

1. A signaling device comprising:

a timer means for producing a timer signal defining a predetermined time;

a pulser means responsive to said timer signal for producing pulse signals at a predetermined rate during said predetermined time:

electrical oscillator means including a piezoelectric transducer and responsive to said pulse signals for producing a predetermined number of audio signals, said electrical oscillator means having a frequency of oscillation different than said predetermined rate of said pulser means.

2. The signaling device of claim 1 and further including a means for resetting said timer means after the predetermined time has elapsed and an input terminal means for initiating the cycle of said timer after it has been reset.

3. The signaling device of claim 1 wherein said timer means includes a resistor and capacitor which determine said predetermined time.

4. The signaling device of claim 1 wherein said pulser means includes a resistor and capacitor which determine said predetermined rate.

* * * * *

US00469793 B1

REEXAMINATION CERTIFICATE (: 932 d)

United States Patent [19]

Matievic

[1 ] I 4,697,932

[45] Certificate Issue ov. 16, 1999

[54] MULTI-SIGNAL ALARM

[75] Inventor: Miroslav Matievic, Indianapolis, Ind.

[73] Assignee: Yosemite Investments, Inc., Indianapolis, Ind.

Reexamination Requests:
No. 90/004,017, Oct. 23, 1995
No. 90/004,145, Feb. 9, 1996

Reexamination Certificate for:

| | |
|---|---|
| Patent No.: | **4,697,932** |
| Issued: | **Oct. 6, 1987** |
| Appl. No.: | **06/807,687** |
| Filed: | **Dec. 11, 1985** |

[51] Int. Cl.[6] ..... G04C 21/16
[52] U.S. Cl. ..... 368/255; 368/250
[58] Field of Search ..... 368/250, 255, 368/244, 245

[56] References Cited

U.S. PATENT DOCUMENTS

| | | |
|---|---|---|
| 3,284,796 | 11/1966 | Borsattino et al. . |
| 3,331,970 | 7/1967 | Dundon et al. . |
| 3,608,454 | 9/1971 | Shenk . |
| 3,631,450 | 12/1971 | Chalfast . |
| 3,681,916 | 8/1972 | Itoyama et al. . |
| 3,697,982 | 10/1972 | Kawaki et al. . |
| 3,759,029 | 9/1973 | Komaki . |
| 3,777,472 | 12/1973 | Iinuma . |
| 3,788,060 | 1/1974 | Kawamura . |
| 3,815,129 | 6/1974 | Sweany . |
| 3,872,470 | 3/1975 | Hoerz et al. . |
| 3,912,952 | 10/1975 | Kumon et al. . |
| 4,012,611 | 3/1977 | Petersen . |
| 4,104,628 | 8/1978 | Sweany et al. . |
| 4,183,278 | 1/1980 | Rea et al. . |
| 4,193,060 | 3/1980 | Slavin et al. . |
| 4,213,121 | 7/1980 | Learn et al. . |
| 4,225,856 | 9/1980 | Learn . |
| 4,234,944 | 11/1980 | Komaki et al. . |
| 4,246,651 | 1/1981 | Komatsu et al. . |
| 4,316,273 | 2/1982 | Jetter . |
| 4,626,799 | 12/1986 | Matievic |

OTHER PUBLI ATIC S

Signetics Analog Applications N nual 979).
EDN/Signetics Article (1973).
FIGS. 6–5 and 6–9b of Signetic Ref. with pin numbers and Matievic reference number dded
Complaint in Yosemite Investm t, Inc . Floyd Bell, Inc. and Floyd Bell Associates, Inc., 2–94 19, United States District Court for the Southern Distri of Ohio, Eastern Division.
Bell's Answer and Affirmative Defen Bell's Amended Answer, and Bell's response to semi s Interrogatory 3. Bell's October 10, 1994 letter t Yoser , with all attachments (identified by exhibit lett ).
*555 Timer Applications Sourc Book* Signetics Analog, 1979, pp. 155, 158, and 165.
*Electronics Magazine*, May, 197 , pag 96 and 97.
*Engineers' Notebook*, Radio Sh k, 19 .
*IC Timer Cookbook*, Howard W Sams 977.
Service Schematic, Kimball Org n.
Motorola Linear/Interface Devi s.
Popular Electronics, "Compon ts fo Electronic Music Systems," Nov., 1973.
Popular Electronics, "Envelope enera s," Jan. 1976.
Eugene R. Hnatek, "Put the IC mer t Vork in A Myriad of Ways," EDN, Mar. 5, 1973.

*Primary Examiner*—Bernard R koski

[57] ABSTR CT

A piezoelectric signaling devic that p duces a predetermined number of audio signals hen a vated. The device includes a timer, a pulser, an a io os ator, and a piezoelectric transducer. The timer nabl the pulser for a predetermined time. While en led, pulser produces pulses at a predetermined rate, us p ucing a predetermined number of pulses. The os lator nabled during the pulses to produce a predetermine numb of pulses of audio frequency electrical oscillation which re applied to the piezoelectric transducer to prod e the determined number of audio signals.

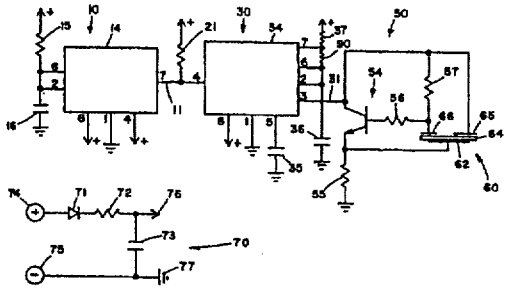

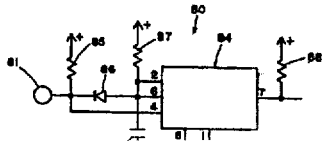

REEXAMINATION CERTIFICATE ISSUED UNDER 35 U.S.C. 307

NO AMENDMENTS HAVE BEEN MADE TO THE PATENT

AS A RESULT OF REEXAM ATIC . IT HAS BEEN DETERMINED THAT:

The patentability of claims 1- is cc .rmed.

* * * *